US012220073B1

(12) United States Patent
Edwards

(10) Patent No.: US 12,220,073 B1
(45) Date of Patent: Feb. 11, 2025

(54) GARMENT STRETCHER

(71) Applicant: Ringo Christopher Mario Edwards, Memphis, TN (US)

(72) Inventor: Ringo Christopher Mario Edwards, Memphis, TN (US)

( * ) Notice: Subject to any disclaimer, the term of this patent is extended or adjusted under 35 U.S.C. 154(b) by 0 days.

(21) Appl. No.: 18/223,516

(22) Filed: Jul. 18, 2023

(51) Int. Cl.
*A47G 25/62* (2006.01)

(52) U.S. Cl.
CPC ..... *A47G 25/627* (2013.01)

(58) Field of Classification Search
CPC ..... A47G 25/62; A47G 25/627; C14B 1/26; C14B 15/06; C14B 2700/07
See application file for complete search history.

(56) References Cited

U.S. PATENT DOCUMENTS

| | | | | |
|---|---|---|---|---|
| 371,038 | A | 10/1887 | Davis | |
| 604,122 | A | 5/1898 | O'Thayne | |
| 784,752 | A | 3/1905 | Nelson | |
| 1,052,426 | A | 2/1913 | Ringler | |
| 1,096,145 | A | 5/1914 | Anderson | |
| 1,581,662 | A | 4/1926 | Sangers | |
| 2,119,604 | A | 6/1938 | Shepherd | |
| 2,120,748 | A | 6/1938 | Harris | |
| 2,122,432 | A | 7/1938 | Maschke | |
| 2,241,895 | A | 5/1941 | Walker | |
| 2,307,256 | A * | 1/1943 | Burwell | D06F 59/02 223/69 |
| 2,195,673 | A | 11/1945 | Kuehne | |
| 2,390,004 | A | 11/1945 | Schoepfer | |
| 2,448,574 | A | 9/1948 | Bothe | |
| 2,539,895 | A | 1/1951 | Cuneo | |
| 2,583,996 | A | 1/1952 | Cavanagh | |
| 2,593,722 | A | 4/1952 | Bothe | |
| 2,626,091 | A | 1/1953 | Reguitti | |
| 2,746,657 | A | 5/1956 | Feathers | |
| 2,850,219 | A * | 9/1958 | Glotzer | A47G 25/62 D6/326 |
| 2,887,257 | A | 5/1959 | Itkonen | |
| 2,929,538 | A | 3/1960 | Douglass | |
| 2,958,447 | A | 11/1960 | Rouseau | |
| 3,517,865 | A | 6/1970 | Kannegiesser | |

(Continued)

FOREIGN PATENT DOCUMENTS

DE 10149271 A1 * 4/2003 ..... A47G 25/325

*Primary Examiner* — Shaun R Hurley
(74) *Attorney, Agent, or Firm* — Baker Donelson; Dorian B. Kennedy; Carl M. Davis, II

(57) ABSTRACT

A garment stretcher includes an expandable frame having a top horizontal member, a middle horizontal member, a bottom horizontal member, a left vertical member and a right vertical member. The expendable frame is formed through the combination of a T-shaped top, left section, a T-shaped top, right section, an inverted L-shaped middle, left section, an inverted L-shaped middle, right section, an inverted T-shaped bottom, left section, and an inverted T-shaped bottom, right section. The top left section and top, right section combine to form a top section. The middle left section and middle, right section combine to form a middle section. The bottom left section and bottom, right section combine to form a middle section. The frame may move vertically along two vertical lengths while the frame may move laterally along a horizontal width of a garment.

10 Claims, 8 Drawing Sheets

(56) References Cited

U.S. PATENT DOCUMENTS

| | | | | |
|---|---|---|---|---|
| 4,364,495 | A | 12/1982 | Walker | |
| 4,830,237 | A | 5/1989 | Louw | |
| 5,113,611 | A * | 5/1992 | Rosson | B44D 3/185 160/381 |
| 5,531,258 | A * | 7/1996 | Poulson | F16B 7/105 256/DIG. 1 |
| 5,557,870 | A | 9/1996 | Bergman | |
| 5,597,099 | A | 1/1997 | Sharp | |
| 6,516,978 | B1 | 2/2003 | Chapman | |
| 7,337,931 | B2 | 3/2008 | Edwards | |
| 2007/0215654 | A1* | 9/2007 | Edwards | D06C 5/005 223/61 |
| 2022/0007869 | A1* | 1/2022 | Lane | A47G 25/483 |
| 2022/0183490 | A1* | 6/2022 | Yoon | A47G 25/4053 |

* cited by examiner

GARMENT STRETCHER

CROSS REFERENCE TO RELATED APPLICATIONS

Not applicable.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

TECHNICAL FIELD

The present disclosure relates to garment stretchers, and more particularly, the disclosure relates to a garment stretcher for re-sizing clothes through vertical and horizontal stretching.

BACKGROUND OF THE INVENTION

Prior art garment stretching devices have existed before. These garment stretchers could stretch a garment, such as sweater, through a vertical and/or horizontal pulling upon the garment.

However, most of these garment stretching devices were complicated to use for the average person that is not in the garment industry and does not use such devices on a regular basis. Furthermore, the prior art devices could result in bumps and irregularities in the final exterior shape of the garment due to the protrusions of certain parts, such as wing nuts and the like. Additionally, the prior art devices fail to provide a simple and effective means for visual identification of the setting size of the garment stretching device.

Another problem with prior art garment stretching devices, such as that shown in U.S. Pat. No. 7,337,931, is that they cannot stretch a shirt, sweater, or like garment in a vertical direction along the portion of the garment below the sleeves or arm holes.

Accordingly, it is seen that a need remains for a garment stretcher which is easy to use, results in a stretch garment that is not deformed, and is able to stretch all portions of the garment. It is to the provision of such therefore that the present invention is primarily directed.

BRIEF SUMMARY OF THE INVENTION

A garment stretcher comprises a top, left frame section, a top, right frame section movably coupled to the top, left frame section for lateral movement relative to the top, left frame section, a middle, left frame section movably coupled to the top, left frame section for vertical movement relative to the top, left frame section, a middle, right frame section movably coupled to the top, right frame section for vertical movement relative to the top, right frame section, a bottom, left frame section movably coupled to the middle, left frame section for vertical movement relative to the middle, left frame section, and a bottom, right frame section movably coupled to the middle, right frame section for vertical movement relative to the middle, right frame section, the bottom, right frame section also being coupled to the bottom, left frame section for lateral movement relative to the bottom, left frame section.

BRIEF DESCRIPTION OF THE DRAWINGS

So that the manner in which the present inventions can be better understood, certain illustrations, charts and/or flow charts are appended hereto. It is to be noted, however, that the drawings illustrate only selected embodiments of the inventions and are therefore not to be considered limiting of scope, for the inventions may admit to other equally effective embodiments and applications.

DETAILED DESCRIPTION OF CERTAIN EMBODIMENTS

Figure 1:
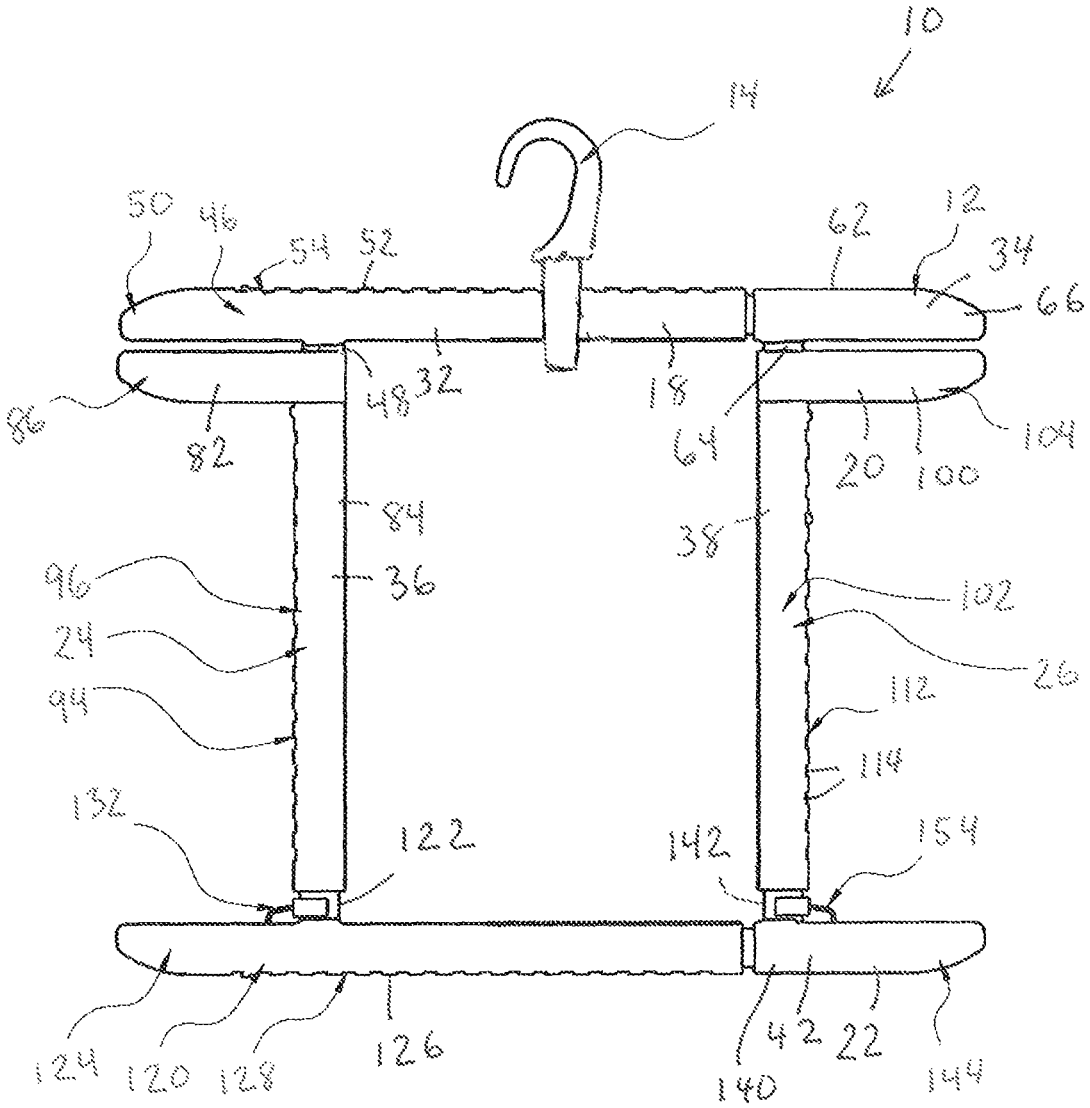
FIG. 1 is a front view of a garment stretcher embodying principles of the invention in a preferred form, shown in a collapsed or pre-stretching configuration.
Figure 2:
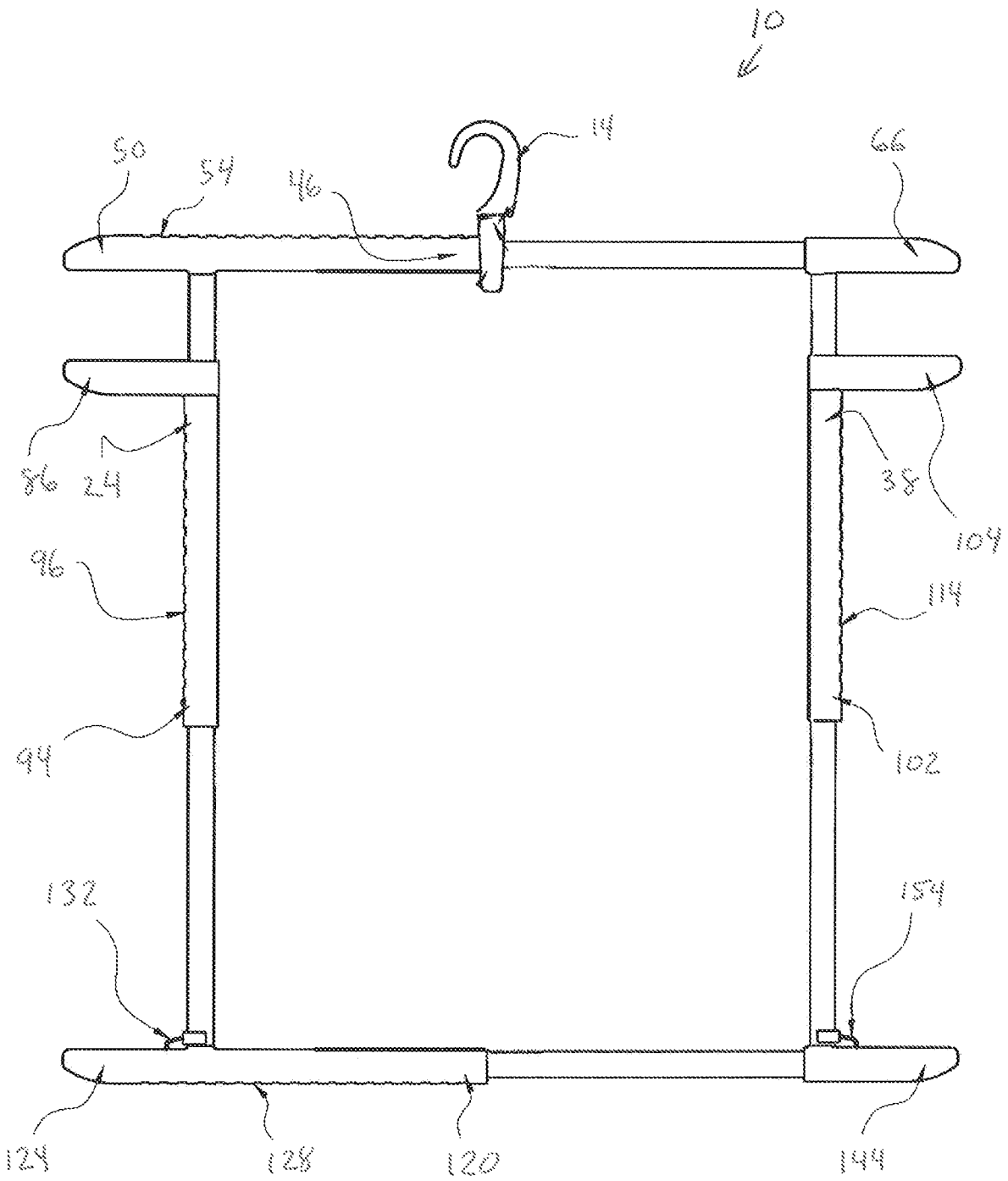
FIG. 2 is a front view of the garment stretcher of FIG. 1, shown in an expanded or stretching configuration.

With reference next to the drawings, there is a shown a garment stretching device or garment stretcher 10 in a preferred form of the invention. The garment stretcher 10 has an expandable frame 12 and a hanging hook 14 movable coupled to the expandable frame 12. The expandable frame 12 may vary in size both horizontally and vertically. The vertical variance in size occurs along two different portions of the frame.

The expandable frame 12 includes a top horizontal member 18, a middle horizontal member 20, and a bottom horizontal member 22. The expandable frame 12 also includes a first or left vertical member 24 and a second or right vertical member 26.

The expendable frame 12 is formed through the combination of a generally T-shaped top, left section 32, a generally T-shaped top, right section 34, a generally inverted L-shaped middle, left section 36, a generally inverted L-shaped middle, right section 38, a generally inverted T-shaped bottom, left section 40, and a generally inverted T-shaped bottom, right section 42. The top left section 32 and top, right section 34 combine to form a top section. The middle left section 36 and middle, right section 38 combine to form a middle section. The bottom left section 40 and bottom, right section 42 combine to form a middle section.

Figure 3:
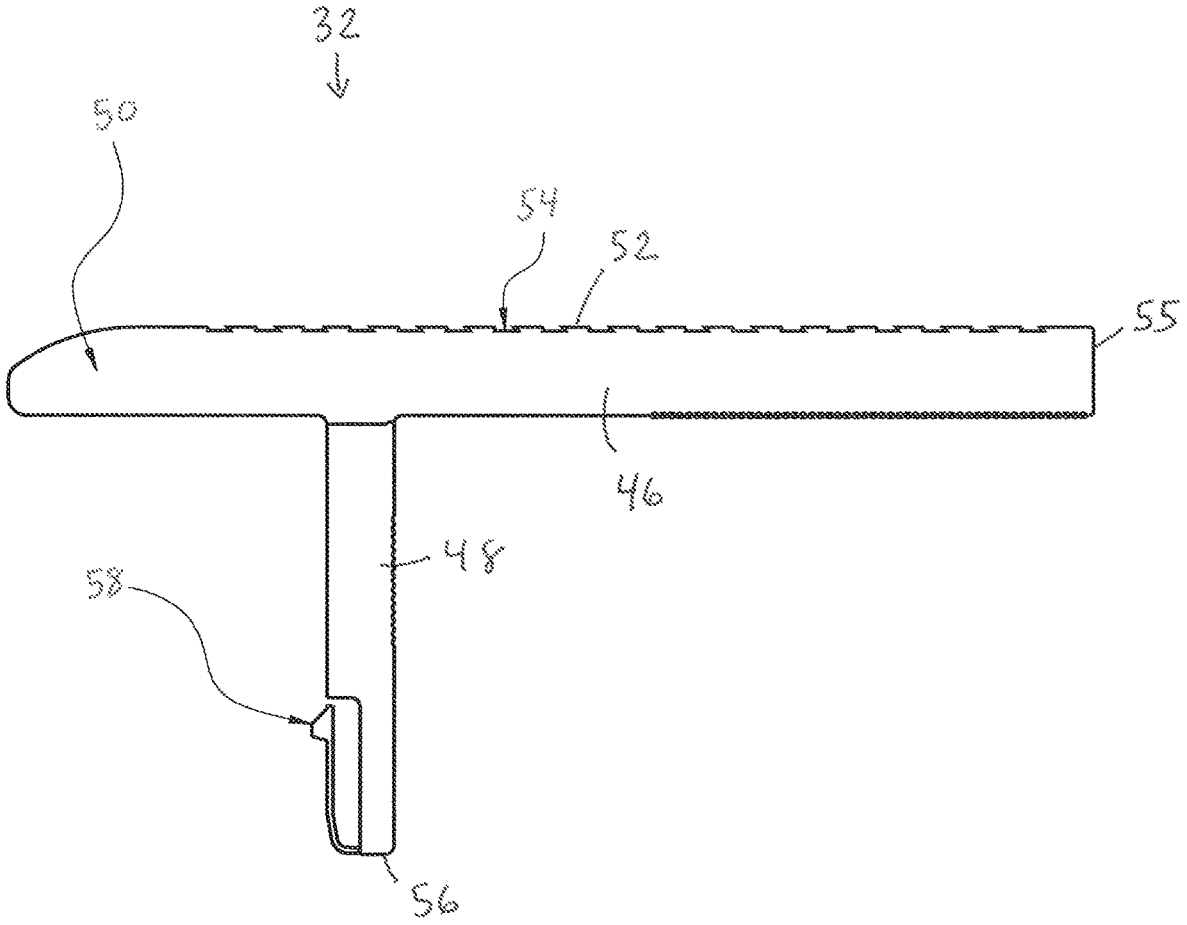
FIG. 3 is a front view of the top, left section of the garment stretcher of FIG. 1.

As best shown in FIG. 3, the top, left section 32 has a tubular, horizontal bar 46 and a vertical bar 48 extending downwardly from the horizontal bar 46. The horizontal bar 46 defines a garment upper arm portion 50 extending to the left past the vertical bar 48. The horizontal bar 46 has a top surface 52 having a series of spacing slots or holes 54 therein. The horizontal bar 46 has an end with an opening 55. The vertical bar 48 has a bottom end 56 with a spring biased catch 58.

Figure 4:
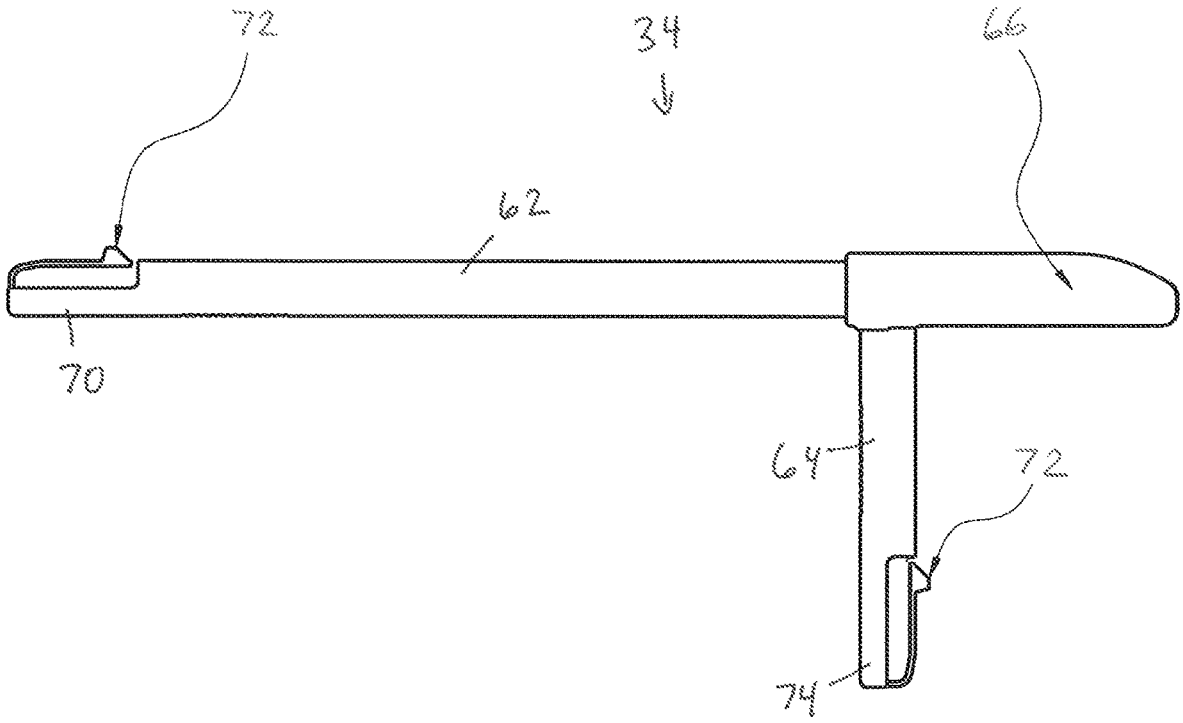
FIG. 4 is a front view of the top, right section of the garment stretcher of FIG. 1.

As best shown in FIG. 4, the top, right section 34 has a tubular, horizontal bar 62 and a vertical bar 64 extending downwardly from the horizontal bar 62. The horizontal bar 62 defines a garment upper arm portion 66 extending to the right of the vertical bar 64. The horizontal bar 62 is configured to be slidably received through opening 55 and within the horizontal bar 46 of the top, left section 32 for relative horizontal movement therebetween. The horizontal bar 62 has a terminal end 70 that includes a spring biased side catch 72 that is configured to be selectively and releasably received within the spacing holes 54 of the horizontal bar 46 of the top, left section 32. The vertical bar 64 has a bottom end 74 with a spring biased bottom catch 72.

Figure 5:
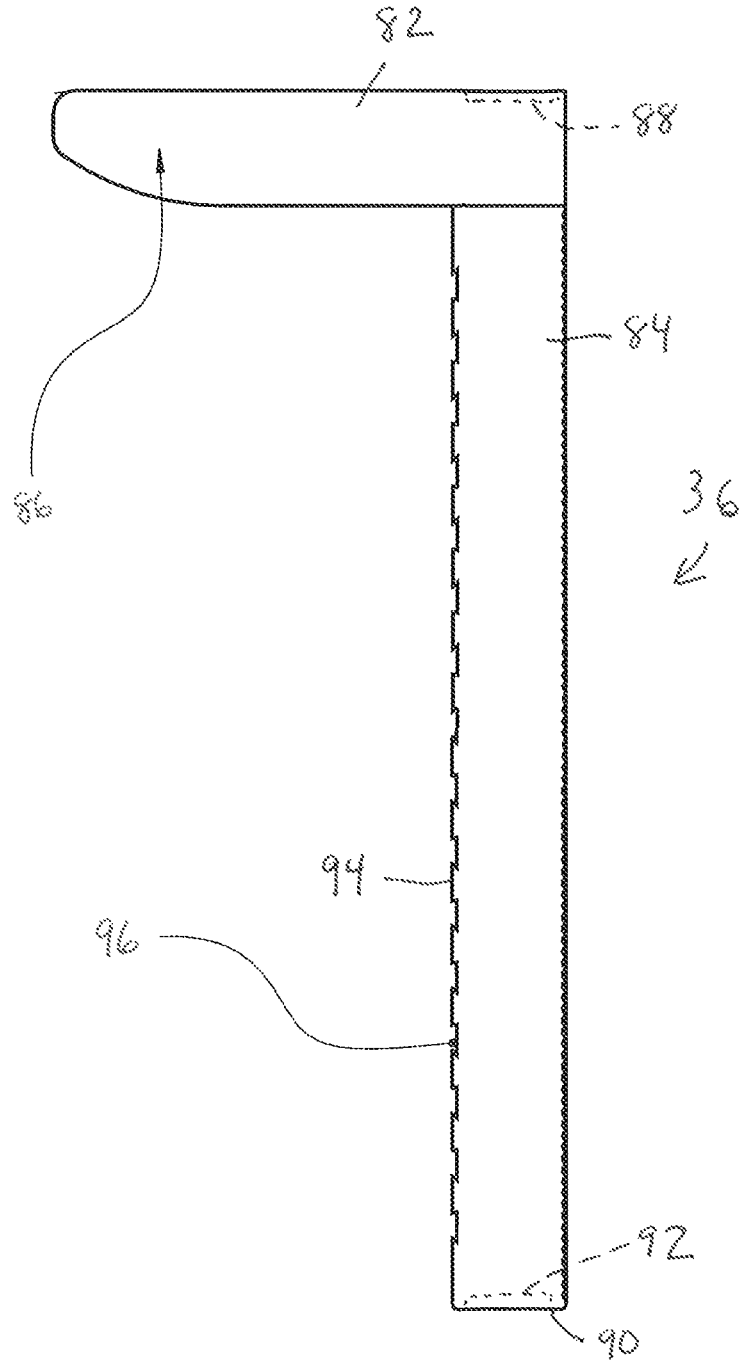
FIG. 5 is a front view of the middle, right section of the garment stretcher of FIG. 1.

As best shown in FIG. 5, the middle, left section 36 has a horizontal bar 82 and a tubular, vertical bar 84 extending from the horizontal bar 82. The horizontal bar 82 defines a garment lower arm portion 86. The horizontal bar 82 has a top opening 88 that extends into the interior space or channel of the tubular, vertical bar 84. The horizontal bar 82 also has a bottom end 90 with a bottom opening 92. The vertical bar 84 has a left side surface 94 having a series of spacing slots or holes 96 therein. The vertical bar 48 of the top, left section 32 is received through the top opening 88 and slidably received within the interior or channel of the vertical bar 84, wherein the spring biased catch 58 of the top, left section 32 may selectively and releasably be received within a spacing hole 96.

Figure 6:
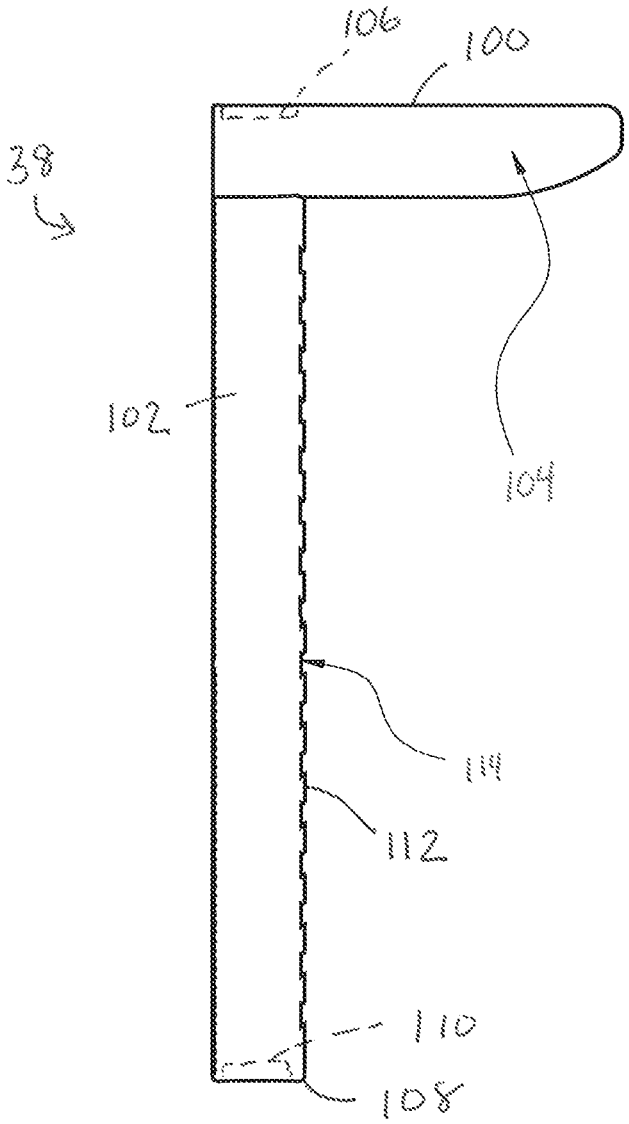
FIG. 6 is a front view of the middle, left section of the garment stretcher of FIG. 1.

As best shown in FIG. 6, the middle, right section 38 has a horizontal bar 100 and a tubular, vertical bar 102 extending from the horizontal bar 100. The horizontal bar 100 defines a garment lower arm portion 104. The horizontal bar 100 has a top opening 106 that extends into the interior space or channel of the tubular, vertical bar 102. The horizontal bar 100 has a bottom end 108 with a bottom opening 110. The vertical bar 102 has a right side surface 112 having a series of spacing slots or holes 114 therein. The vertical bar 64 of the top, right section 34 is received through the top opening 106 and slidably received within the interior or channel of the vertical bar 102 wherein the spring biased catch 72 may selectively and releasably be received within a spacing hole 114.

Figure 7:
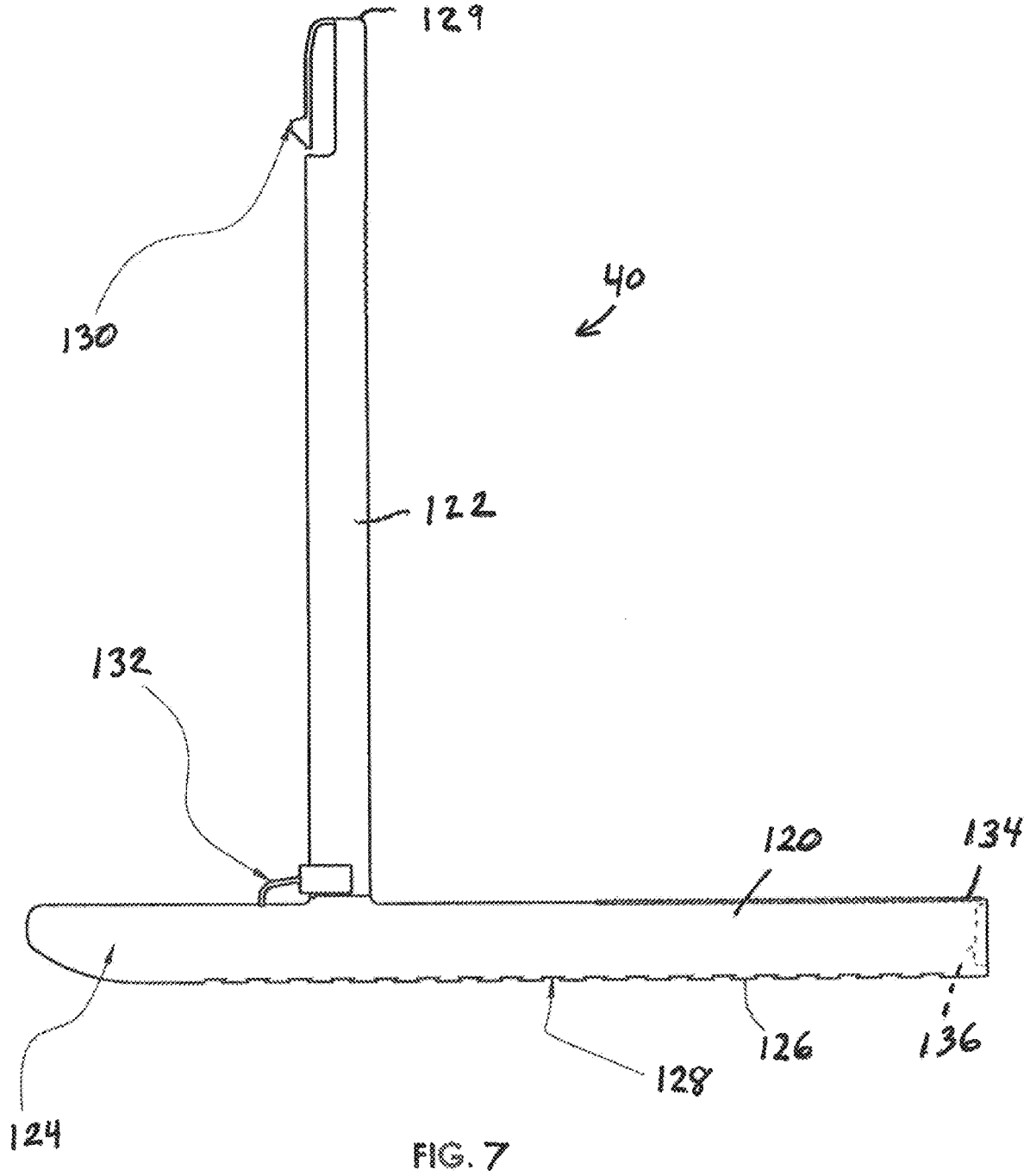
FIG. 7 is a front view of the bottom, right section of the garment stretcher of FIG. 1.

As best shown in FIG. 7, the bottom, left section 40 has a tubular, horizontal bar 120 and a vertical bar 122 extending upwardly from the horizontal bar 120. The horizontal bar 120 defines a garment lower portion 124 extending to the left past the vertical bar 122. The horizontal bar 120 has a bottom surface 126 having a series of spacing slots or holes 128 therein. The vertical bar 122 has a top end 129 with a spring biased catch 130. The vertical bar 122 is configured to be passed through the bottom opening 92 and slidably received within the interior space of the vertical bar 84 of the middle, left section 36 wherein the spring biased catch 130 may be selectively and releasably received within a spacing hole 96 of the middle, left section 36. The horizontal bar 120 also has a spring loaded garment retaining clip 132. Lastly, the horizontal bar 120 has a right end 134 with a right opening 136 to the interior space of the horizontal bar 120.

Figure 8:
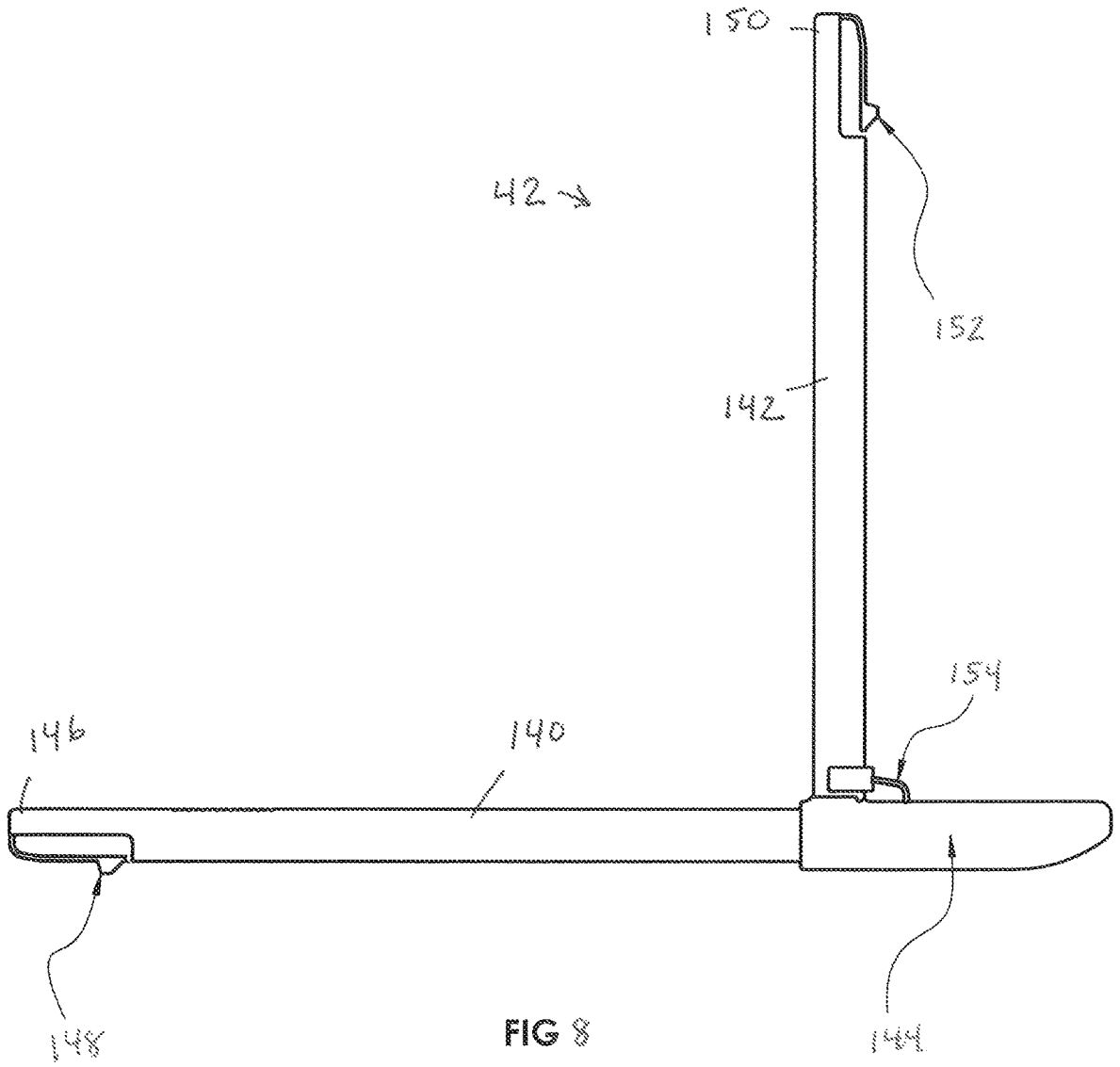
FIG. 8 is a front view of the bottom, left section of the garment stretcher of FIG. 1.

As best shown in FIG. 8, the bottom, right section 42 has a tubular, horizontal bar 140 and a vertical bar 142 extending upwardly from the horizontal bar 140. The horizontal bar 140 defines a garment lower portion 144 extending to the right of the vertical bar 142. The horizontal bar 140 configured to be inserted through opening 136 and slidably received within the interior or channel of the horizontal bar 120 of the bottom, left section 40 for relative horizontal movement therebetween. The horizontal bar 140 has a terminal end 146 that includes a spring biased catch 148 that is configured to be selectively and releasably received within the spacing holes 128 of horizontal bar 120 of the bottom, left section 40. The vertical bar 142 has a top end 150 with a spring biased top catch 152. The horizontal bar 140 also has a spring loaded garment retaining clip 154.

In use, a garment, such as shirt or sweater, is positioned onto the garment stretcher 10 so that the garment upper arm portions 50 and 66 and the garment lower arm portions 86 and 104 extend through the arm holes in the torso portion of the garment and the remaining portion extend across the torso of the garment. The bottom edge or hem of the garment is then draped over the garment lower portions 124 and 144. The garment material adjacent the bottom edge of the garment is maintained in place by the pinching actuation of the garment clips 132 and 154 and the positions of the garment lower portions 124 and 144.

The upper portion of the garment may be vertically stretched by manually depressing catches 58 and 72 of the top, left section 32 and top, right section 34 and displacing them from within their respective holes 96 and 114 to allow relative movement between the top, left and right sections 32 and 34 relative to the middle, left and right sections 36 and 38 along a first vertical garment length. The middle left section 36 and middle, right section 38 are then moved vertically downward until they reach their selected stretching or extended position and the spring biased catches 58 and 72 are released and reinserted into corresponding holes 96 and 114 to maintain the positions of the middle right and left sections 36 and 38. This action will cause the garment to be stretched vertically along a first vertical garment length in the area of the garment torso between the garment shoulders and the garment arm holes or sleeves.

The entire garment, including the lower portion of the garment, may be vertically stretched along a second vertical garment length by manually depressing catches 130 and 152 of the bottom, left section 40 and bottom right section 42 and displacing them from within their respective holes 96 and 114 to allow relative movement between the bottom, left and right sections 40 and 42 relative to the middle, left and right sections 36 and 38. The bottom, left section 40 and bottom, right section 42 are then moved vertically downward until they reach their selected stretching or extended position and the spring biased catches 130 and 152 are released and reinserted into corresponding holes 96 and 114 to maintain the positions of the bottom, right and left sections 40 and 42. This action will cause the garment to be stretched vertically along the entire garment or second garment length, but particularly including the area of the garment torso between the garment arm holes and the lower edge or hem that was not previously addressed with the prior art garment stretchers.

The torso of the garment may be horizontally stretched by manually depressing catch 72 of the top, right section 34 and catch 148 of the bottom, right section 42 and displacing them from within their respective holes 54 and 128 to allow relative movement between the top, right section 34 and bottom, right section 42 relative to the top, left section 32 and bottom, left section 40. The top, right section 34 and bottom, right section 42 are then moved horizontally sideways or laterally until they reach their selected stretching or extended position and the spring biased catches 72 and 148 are released and reinserted into corresponding holes 54 and 128 to maintain the positions of the top, right section 34 relative to the top, left section 32 and the bottom, right section 42 relative to the bottom, left section 40. This action will cause the garment to be stretched horizontally in the area of the garment torso.

It should be understood that with the present invention, a garment may be stretched along the top region of the torso through expanding movement between the upper arm portions 50 and 66 relative to the lower arm portions 86 and 104. Similarly, a garment may be stretched along the entire torso through expanding movement between the upper arm portions 50 and 66 relative to the garment lower portions 124 and 144. Lastly, a garment may be stretched horizontally along the entire torso through expanding movement between the left side of the frame 12 and the right sides of the frame 12 through expanding movement between the top, left section 32 and the top, right section 34, and between the bottom, left section 40 and the bottom, right section 42.

Thus, it should be understood that the garment stretcher includes a top, left frame section, a top, right frame section movably coupled to the top, left frame section for lateral movement relative to the top, left frame section, a middle, left frame section movably coupled to the top, left frame section for vertical movement relative to the top, left frame section, a middle, right frame section movably coupled to the top, right frame section for vertical movement relative to the top, right frame section, a bottom, left frame section movably coupled to the middle, left frame section for vertical movement relative to the middle, left frame section, and a bottom, right frame section movably coupled to the middle, right frame section for vertical movement relative to the middle, right frame section, the bottom, right frame section also being coupled to the bottom, left frame section for lateral movement relative to the bottom, left frame section.

It should be understood that all the previously recited catches and matching holes may be referenced as catches or catching systems, releasable catches, or releasable couplers.

It should also be understood that the previously recited upper arm portions 50 and 66, lower arm portions 86 and 104, and garment lower portions 124 and 144 may be referenced as fingers, protrusions, projections or the like.

Lastly, is should be understood that the portions of the horizontal bars 46 and 62 positioned between their respective pairs of vertical bars may be referenced as a central portion or central bar.

It thus is seen that a garment stretcher is now provided which overcomes problems associated with prior art systems. While this invention has been described in detail with particular references to the preferred embodiments thereof, it should be understood that many modifications, additions and deletions, in addition to those expressly recited, may be made thereto without departure from the spirit and scope of the invention.

The invention claimed is:

1. A garment stretcher comprising:

a top, left frame section;

a top, right frame section movably coupled to said top, left frame section for lateral movement relative to said top, left frame section;

a middle, left frame section movably coupled to said top, left frame section for vertical movement relative to said top, left frame section;

a middle, right frame section movably coupled to said top, right frame section for vertical movement relative to said top, right frame section;

a bottom, left frame section movably coupled to said middle, left frame section for vertical movement relative to said middle, left frame section, and a bottom, right frame section movably coupled to said middle, right frame section for vertical movement relative to said middle, right frame section, said bottom, right frame section also being coupled to said bottom, left frame section for lateral movement relative to said bottom, left frame section, wherein said top, left frame section includes a first horizontal bar and a first vertical bar coupled to said first horizontal bar so as to define a first upper arm portion extending laterally and outboard of said first vertical bar, and wherein said top, right frame section includes a second horizontal bar and a second vertical bar coupled to said second horizontal bar so as to define a second upper arm portion extending laterally and outward of said second vertical bar.

2. The garment stretcher of claim 1 wherein said bottom, left frame section includes a third horizontal bar and a third vertical bar coupled to said third horizontal bar so as to define a first lower portion extending laterally and outboard of said third vertical bar, and wherein said top, right frame section includes a fourth horizontal bar and a fourth vertical bar coupled to said fourth horizontal bar so as to define a second lower portion extending laterally and outboard of said fourth vertical bar.

3. The garment stretcher of claim 2 wherein said middle, left frame section includes a fifth vertical bar and a third arm portion extending laterally and outboard from said fifth vertical bar, and wherein said middle, right frame section includes a sixth vertical bar and a fourth arm portion extending laterally and outboard from said sixth vertical bar.

4. The garment stretcher of claim 2 wherein said bottom, left frame section includes a first garment holding clip, and wherein said bottom, right frame section includes a second garment holding clip.

5. The garment stretcher of claim 1 further comprising a first catch system releasably coupling said top, left frame section to said middle, left frame section, a second catch system releasably coupling said top, right frame section to said middle, right frame section, a third catch system releasably coupling said bottom, left frame section to said middle, left frame section, and a fourth catch system releasably coupling said bottom, right frame section to said middle, right frame section.

6. The garment stretcher of claim 5 further comprising a fifth catch system releasably coupling said top, left frame section to said top, right frame section, and a sixth catch system releasably coupling said bottom, left frame section to said bottom, right frame section.

7. A garment stretcher adapted to stretch a garment having a torso and two oppositely disposed arm sleeves, said garment stretcher comprising:

a top section configured to extend laterally across the torso portion of the garment and to extend into a top portion of both oppositely disposed arm sleeves of the garment;

a middle section configured to extend laterally across the torso portion of the garment and to extend into a bottom portion of both oppositely disposed arm sleeves of the garment, said middle section being movable between a contracted position proximal said top section and an extended position distal said top section so as to stretch the garment along a first vertical garment length, and a bottom section configured to extend laterally across the torso portion of the garment and to releasably hold a bottom portion of the garment, said bottom section being movable between a contracted position proximal said middle section and an extended position distal said middle section so as to stretch the garment along a second vertical garment length, wherein said top section has a first top section and a second top section laterally movable to a plurality of different positions relative to said first top section, wherein said middle section has a first middle section and a second middle section laterally movable to a plurality of different positions relative to said first middle section, and wherein said bottom section has a first bottom section and a second bottom section laterally movable to a plurality of different positions relative to said first bottom section, the lateral movements of said first and second top sections, said first and second middle sections and said first and second bottom sections stretching the garment along a horizontal garment width, and wherein said bottom section has first vertical bar, a second vertical bar spaced from said first vertical bar, a first horizontal central bar extending between said first and second vertical bars, a first lower finger extending outwardly from said first vertical bar in a direction opposite from said first horizontal central bar, and a second lower finger extending outwardly from said second vertical bar in a direction opposite from said horizontal bar.

8. The garment stretcher of claim 7 wherein said top section has a third vertical bar, a fourth vertical bar spaced from said third vertical bar, a second horizontal central bar extending between said third and fourth vertical bars, a first upper finger extending outwardly from said third vertical bar in a direction opposite from said second horizontal central bar, and a second upper finger extending outwardly from said fourth vertical bar in a direction opposite from said second horizontal central bar.

9. The garment stretcher of claim 8 wherein said middle section has a fifth vertical bar and a first middle finger extending outwardly from said fifth vertical bar, and a sixth vertical bar and a second middle finger extending outwardly from said sixth vertical bar.

10. The garment stretcher of claim 7 wherein said bottom section includes at least one garment holding clip.

* * * * *